United States Patent [19]

Stancato

[11] 4,378,647

[45] Apr. 5, 1983

[54] PHOTOGRAPHIC ALBUM AND METHOD OF FABRICATION OF SAME

[76] Inventor: Vincenzo Stancato, 1717 Broadway, Hewlett, N.Y. 11557

[21] Appl. No.: 105,662

[22] Filed: Dec. 20, 1979

[51] Int. Cl.[3] ..... A47G 1/06; G09F 1/10; B42D 3/00

[52] U.S. Cl. ..... 40/158 R; 281/29

[58] Field of Search ..... 40/158 R, 158 A, 158 B, 40/159; 281/38, 29

[56] References Cited

U.S. PATENT DOCUMENTS

| | | | |
|---|---|---|---|
| 2,515,820 | 7/1950 | Clark | 40/158 R |
| 3,815,920 | 6/1974 | Carter et al. | 281/29 |
| 3,839,960 | 10/1974 | Bissonet | 281/29 |
| 4,231,833 | 11/1980 | Lieberman | 40/158 R |
| 4,237,633 | 12/1980 | Murrell | 40/158 R |
| 4,294,469 | 10/1981 | Errichiello | 281/29 |
| 4,296,561 | 10/1981 | Lawrence | 40/158 R |

*Primary Examiner*—Gene Mancene
*Assistant Examiner*—Michael J. Foycik

[57] ABSTRACT

This invention relates to an improved design associated with photographic albums and method for the fabricating thereof such that an individual is capable of mounting on the pages of said album pictures such that by the utilization of the various methods of matting, there is achieved a uniform plane over the surface of each of said album's pages resulting in what appears to be an album that has been individually bound thereby creating a prefabricated photographic album which is capable of having pictures mounted in accordance with this invention upon the blank pages thereof by use of mats incorporating this invention thus giving the appearance of an individualized prebound album. Additionally, the blank pages of said album are bound together in such a manner so as to provide a uniform plane surface at the binding of the album independent of the page to which said album is opened.

6 Claims, 34 Drawing Figures

PHOTOGRAPHIC ALBUM AND METHOD OF FABRICATION OF SAME

BACKGROUND AND OBJECTS OF THE INVENTION

The present invention relates generally to a new and improved design for a photographic album and method for fabrication of same, said design providing a pre-bound album capable of having mounted upon its pages with the use of mats designed in accordance with this invention pictures and the like such that there is achieved a means for a photographer within his own studio to be able to create what appears to be a customized and hand bound album whose individual pages provide a uniform plane surface once having mounted thereon the particular pictures in question.

Prior to the present invention, photographic albums did exist but of a design and fabrication which did not achieve the advantages of the present invention in that there was not available to a photographer a pre-bound photographic album having blank pages that would permit his mounting thereon of pictures such that the overall aesthetic appearance thereof suggested that the individual pages of said album were each separately mounted with the picture in question and then the pages assembled and bound into an album.

It is therefore an object of this invention to create a new and unique photographic album and method fabrication of same wherein a photographic album is created which is pre-bound prior to the mounting of pictures on each of its pages but evidences the aesthetic appearance of having had each individual page mounted with the picture contained thereon and then said individual pages assembled and bound into an album.

It is another object of this invention to create a new and unique photographic album and method of fabrication of same wherein each page of said album when opened thereto evidenced a uniform plane across its entire surface.

It is another object of this invention to create a new and unique photographic album and method of fabrication of same wherein means are provided to have mounted on the exterior of the front cover of said album a decorative panel.

It is another object of this invention to create a new and unique photographic album and method of fabrication of same wherein the individual pages of said album are bound together at the binding in such a manner as to provide a uniform plane surface at the point of said binding.

The objects and advantages of the invention are set forth in part herein and in part will be obvious herefrom, or may be learned by practice of the invention, the same being realized and attained by means of the instrumentalities and combinations pointed out in the appended claims.

The invention consists in the novel parts, constructions, arrangements, conbinations and improvements herein shown and described.

SUMMARY OF THE INVENTION

Briefly described the present invention relates to an improved design associated with photographic albums and the method for their fabrication such that an individual, be it a photographer, or otherwise, is capable of mounting on the pages of said album pictures such that by the utilization of the various mat designs and procedures herein disclosed there is achieved after the mounting of a picture or the like upon each page of said album, a uniform plane over the surface of each of said album's pages resulting in what appears to be a customized and hand bound album, when in reality, same is not the case.

As herein preferably embodied, the photographic album and method of fabricating same incorporates an album that is pre-bound with individual pages capable of receiving thereon the mounting of pictures and the like, within a recessed, cutout portion thereof, symmetrically positioned on both front and back surfaces of said pages whereby upon the affixing of precut mats within the recesses of said pages, said mats having affixed thereto the pictures in question, there is created a photographic album that evidences an appearance of being customized and hand bound. Additionally, by utilizing a similar technique, there is the ability to individually customize the front cover of said album by providing a method to insert within a symmetrically positioned portion of said cover individualized decorative items, be they pictures, or otherwise, resulting in an aesthetic appearance unique to album construction.

Furthermore, by utilizing individualized pages of said album that are folded along the edge of each page, said folded edge being incorporated in the album's binding, there is achieved a prebound album that, when opened at any page thereof, evidences a flat plane surface across the entire plane thereof inclusive of both of the pages and binding of said album.

The accompanying drawings referred to herein and constituting a part hereof are illustrative of the invention but not restrictive thereof, and, together with the description, serve to explain the principles of the invention.

DESCRIPTION OF A PREFERRED EMBODIMENT

Figure 1:
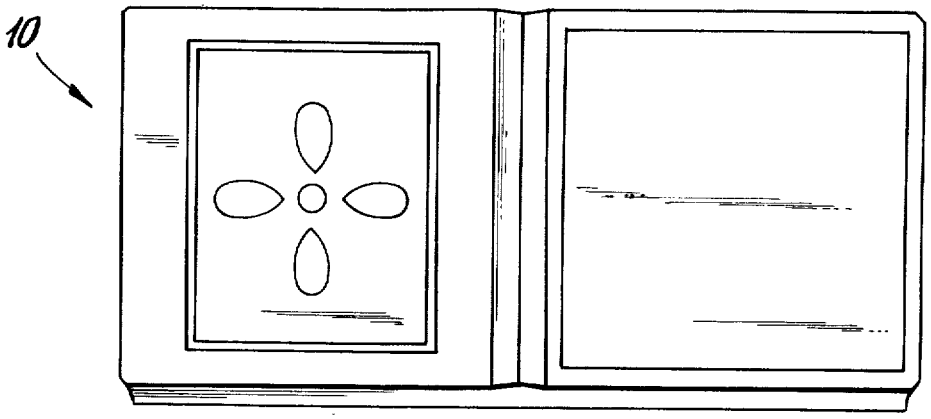
FIG. 1 is a three dimentional perspective view of a photographic album constructed in accordance with the invention.
Figure 2A:
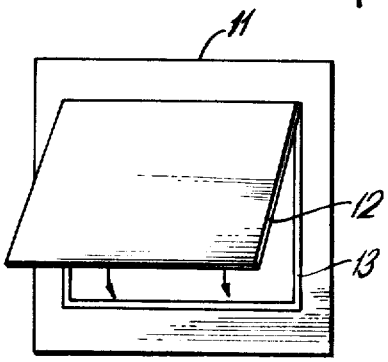
FIG. 2*a* is a rear elevational view of a mat assembly constructed in accordance with one embodiment of this invention evidencing the first step in mounting a picture in accordance with this invention.
Figure 2B:
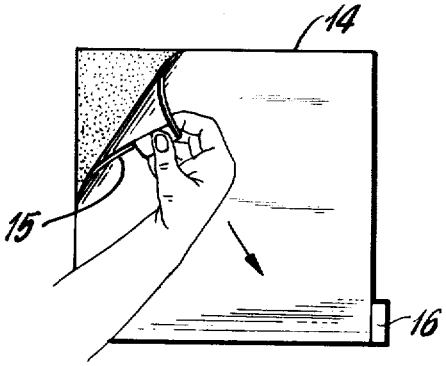
FIG. 2*b* is a front elevational view of an adhesive sheet constructed in accordance with this invention said adhesive sheet having adhesive material appearing on both of its surfaces, and evidencing the second step in the process of mounting a picture in accordance with one embodiment of the invention wherein a protective cover sheet is removed to expose one adhesive surface of said sheet.
Figure 2C:
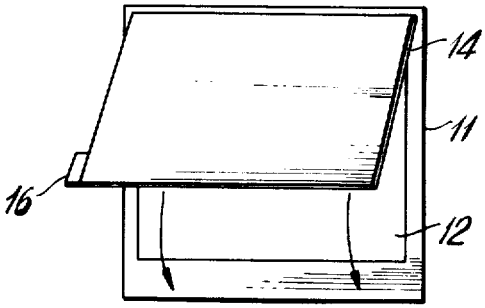
FIG. 2*c* is a rear elevational view of the mat assembly depicted in FIG. 2*b* having the exposed adhesive surface applied to said mat assembly, said step being the third step in the process of mounting a picture in accordance with one embodiment of the invention.
Figure 2D:
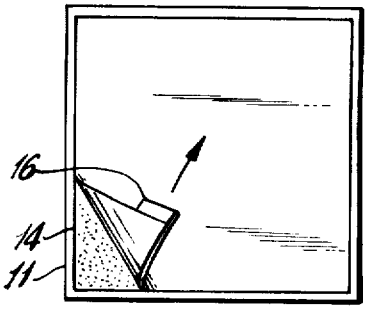
FIG. 2*d* evidences the fourth step in the process of mounting a picture in accordance with one embodiment of the invention wherein the remaining protective sheet covering the adhesive sheet depicted in FIG. 2*b* is removed exposing an adhesive surface.
Figure 2E:
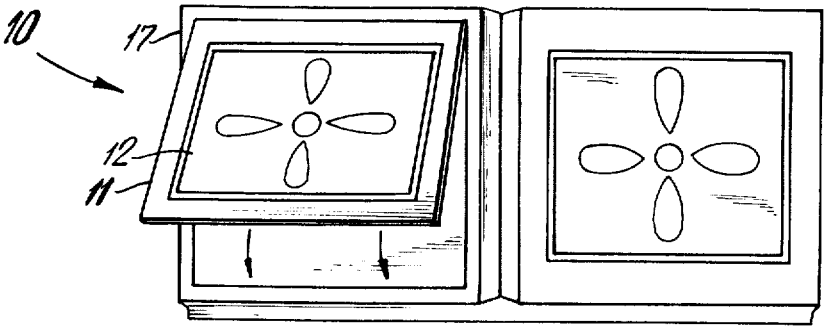
FIG. 2*e* depicts the mounting of the mat assembly with picture and adhesive backing in accordance with one embodiment of the invention onto a blank page of said album.
Figure 3A:
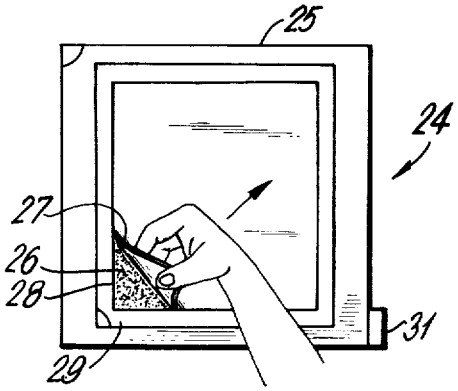
FIG. 3*a* is a rear elevational view of a mat assembly constructed in accordance with a second alternative embodiment of this invention evidencing the first step in mounting a picture in accordance with the invention wherein a protective covering is removed exposing an adhesive surface.
Figure 3B:
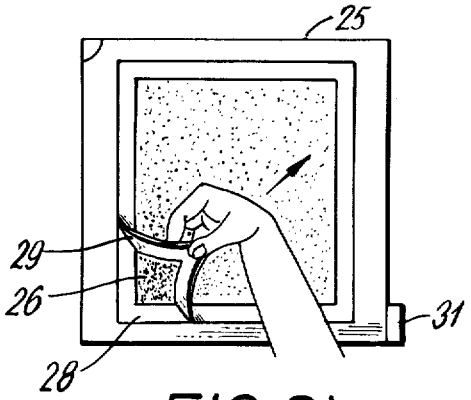
FIG. 3*b* evidences the rear elevational view of the mat assembly depicted in FIG. 3*a* but evidencing the second step in the process of mounting a picture in accordance with a second alternative embodiment of the invention wherein a second protective covering is removed which borders the adhesive area exposed as depicted in FIG. 3*a*.
Figure 3C:
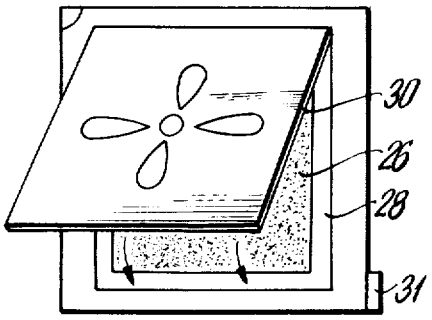
FIG. 3*c* is a front elevational view of the mat assembly depicted in FIG. 3*a* wherein there is depicted as the third step in the process of mounting a picture in accordance with the second alternative embodiment of this invention the placing of a picture upon said mat assembly.
Figure 3D:
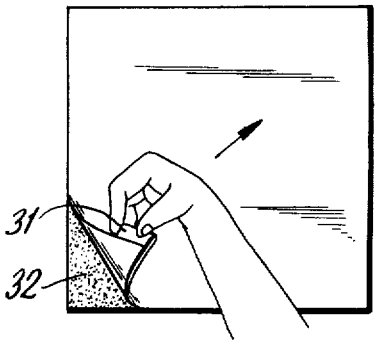
FIG. 3*d* is a real elevational view of the mat assembly depicted in FIG. 3*c* wherein there is depicted the fourth step in the process of mounting a picture in accordance with the second alternative embodiment of the invention wherein a protective sheet covering an adhesive surface on the back of said mat assembly is removed exposing said adhesive surface.
Figure 3E:
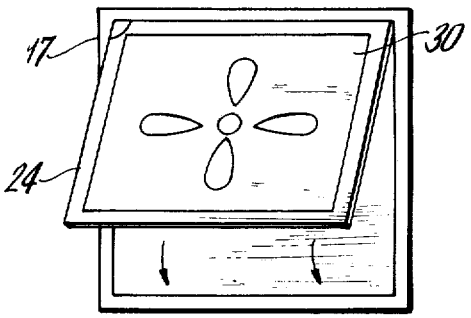
FIG. 3*e* evidences the fifth step in the process of mounting a picture in accordance with the second alternative embodiment of said invention wherein the mat assembly depicted in FIG. 3*c* is mounted onto a blank page of said album.
Figure 3F:
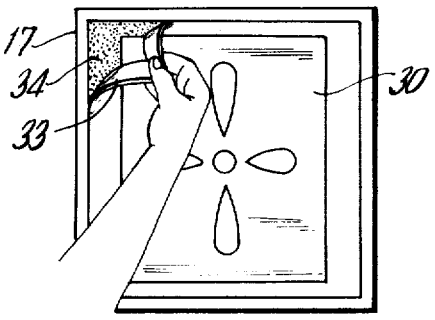
FIG. 3*f* depicts the sixth step in the process of mounting a picture in accordance with the second alternative embodiment of said invention wherein there is depicted the removal of a protective sheet covering adhesive material that frames the mounted picture such that a second mat can then be positioned thereon.
Figure 3G:
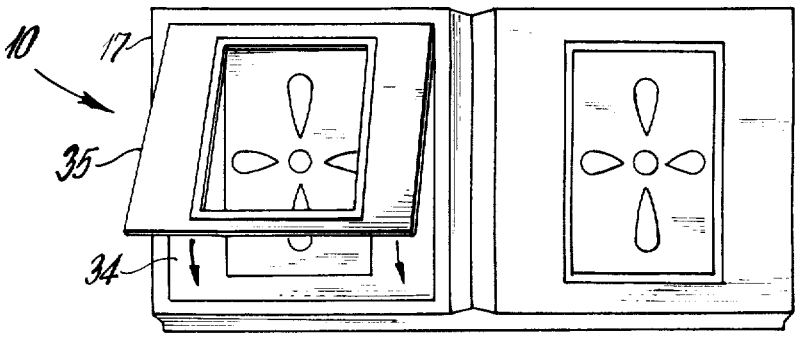
FIG. 3*g* depicts the seventh step in the process of mounting a picture in accordance with the second alternative embodiment of this invention wherein a mat frame is mounted upon the page of said album thus framing the picture in question.
Figure 4A:
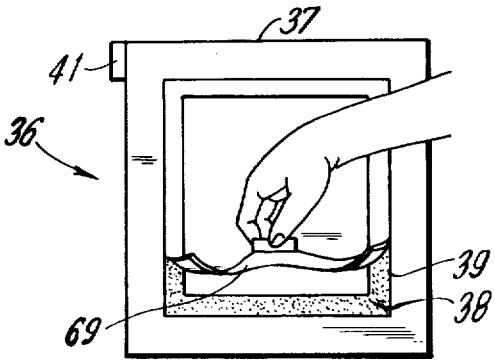
FIG. 4*a* is a rear elevational view of a mat assembly constructed in accordance with a third alternative embodiment of this invention evidencing the first step in mounting a picture in accordance with the invention.
Figure 4B:
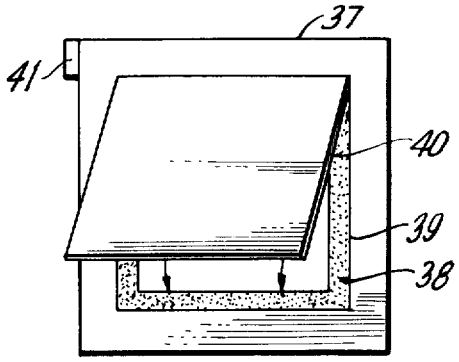
FIG. 4*b* evidences the rear elevational view of the mat assembly depicted in FIG. 4*a* but evidencing the second step in the process of mounting a picture in accordance with a third alternative embodiment of the invention wherein after having had an adhesive area exposed about the center opening of said mat assembly, a picture is inserted.
Figure 4C:
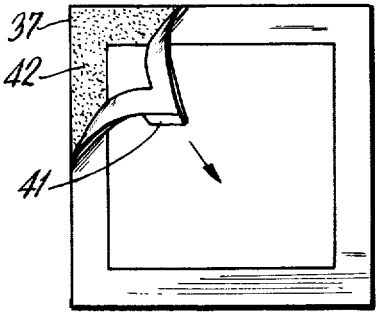
FIG. 4*c* is a rear elevational view of the mat assembly depicted in FIG. 4*b* wherein there is depicted as the third step in the process of mounting a picture in accordance with the third alternative embodiment of this invention the exposing of an adhesive surface about the border area of said mat assembly.
Figure 4D:
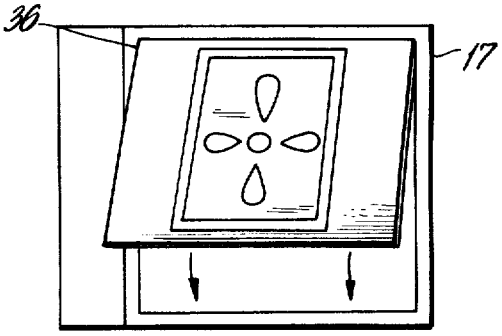
FIG. 4*d* evidences the fourth step in the process of mounting a picture in accordance with the third alternative embodiment of said invention wherein said mat assembly is mounted upon the page of said album.

Referring now more particularly to the embodiment of the above invention illustrated in the accompanying drawings, there is illustrated in FIG. 1 a photographic album fabricated and constructed in accordance with the invention and indicated generally by reference numeral 10.

In accordance with the invention, and as illustrated in FIGS. *2a–2e*, there id depicted a method of fabricating a photographic album in accordance with this invention. More particularly, in FIG. *2a* there is depicted mat 11 which is constructed from any material well known in the prior art for same, and preferably constructed of a thick composition of paper material evidencing properties of strength and decorative aesthethic appearance. As depicted in FIG. *2a*, mat 11 has cut out from its surface a symmetrically positioned opening of a size slightly smaller than the size of picture 12 that is to be mounted thereon. Furthermore, there is pre-cut in mat 11 an indented recess 13 symmetrically positioned about the opening in said mat identical in size to the picture 12 to be placed thereon, the depth of said indented recess 13 being of a depth equal to the thickness of the picture 12 that is to be mounted therein such that once said picture 12 is mounted on mat 11 within said idented recess 13 the thickness of mat 11 is uniform throughout its rear surface.

Upon placing picture 12 within the area defined by indented recess 13, adhesive sheet 14, which is of a size slightly smaller than that of mat 11 and which has both of its surfaces covered with any adhesive material well known in the prior art that is suited to adhering to various compositions of paper and which has protective coverings 15 and 16 covering said adhesive surfaces, then has removed from it protective covering 15 so as to expose one of the adhesive surfaces of sheet 14. As illustrated in FIG. *2c*, the exposed adhesive surface of sheet 14 is then symmetrically place against the back of mat 11 once picture 12 has already been inserted within indented recess 13 of mat 11. In this manner, there is created a picture 12 permanently affixed to a mat 11 and symmetrically positioned in association therewith, said picture 12 and mat 11 being capable of mounting within album 10 in accordance with this invention.

In FIG. *2d* there is illustrated the next step in the process of fabricating a photographic album in accordance with this invention wherein protective covering 16 is removed exposing the remaining adhesive surface of sheet 14 thereby providing the means to permanently affix picture 12 and mat 11 to page 17 of album 10 as illustrated in FIG. *2e* which is accomplished by placing in contact onto page 17 of album 10 within the defined pre-cut indented area thereof the exposed adhesive surface affixed to the back of mat 11 and picture 12. In this manner, there is created an album 10 that appears to have each of its pages mounted thereon with a picture prior to binding the album together, but which in reality is not the case.

Figure 8:
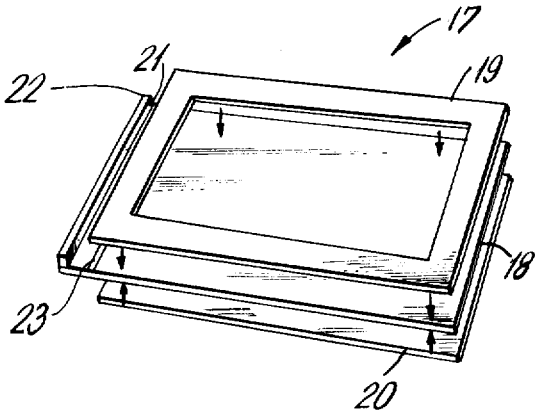
FIG. 8 illustrates the fabrication of an individual page of said album.
Figure 7A:
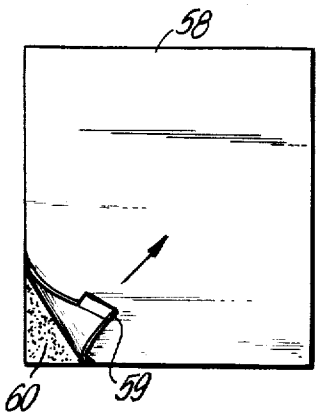
FIG. 7*a* represents a front elevational view of an adhesive sheet constructed in accordance with this invention, same being utilized in accordance with a second alternative embodiment of the invention applicable to the mounting of a decorative insert onto the exterior cover of said album, wherein there is initially exposed the adhesive surface of said adhesive sheet as the first step in the process of mounting said insert.
Figure 7B:
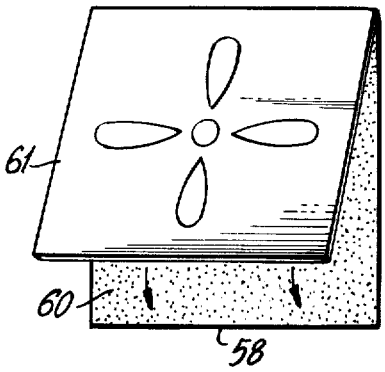
FIG. 7*b* evidences the second step in the process of mounting a decorative insert onto the exterior cover of said album in accordance with a second alternative embodiment of the invention wherein there is evidenced the mounting of a decorative insert onto the exterior surface of said album wherein the exposed adhesive surface evidenced in FIG. 7*a* is mounted upon the back surface of said decorative insert.
Figure 7C:
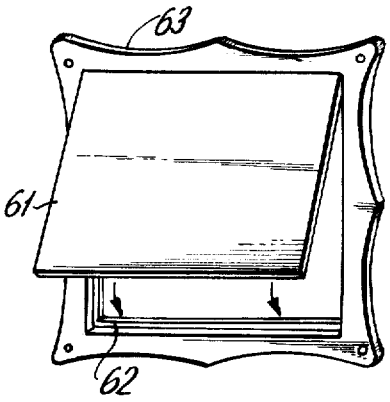
FIG. 7*c* depicts the third step in the process of mounting a decorative insert onto the exterior cover of said album in accordance with a second alternative embodiment of the invention wherein the decorative insert depicted in FIG. 7*b* is placed within a precut frame.
Figure 7D:
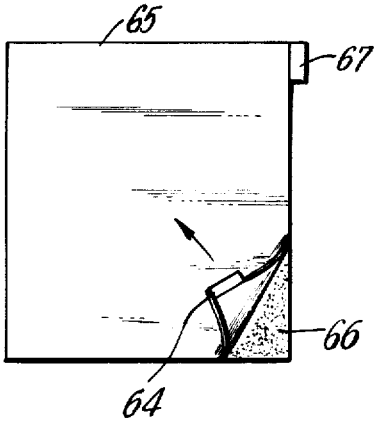
FIG. 7*d* depicts the fourth step in the process of mounting a decorative insert onto the exterior cover of said album in accordance with a second alternative embodiment wherein there is depicted a second adhesive sheet constructed in accordance with this invention, said second adhesive sheet having adhesive material appearing on both of its surfaces, said fourth step being the removal of one of the protective cover sheets so as to expose one of the adhesive surfaces of said second adhesive sheet.
Figure 7E:
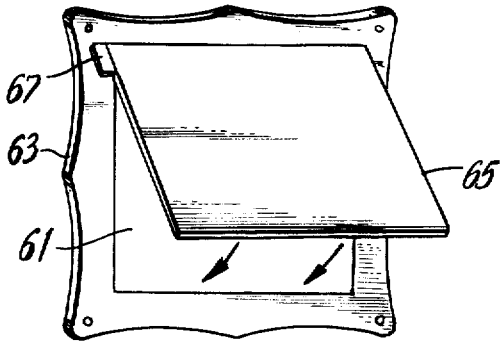
FIG. 7*e* depicts the fifth step in the process of mounting a decorative insert onto the exterior cover of said album in accordance with a second alternative embodiment of the invention there being depicted the placing of said exposed adhesive surface of said second adhesive sheet as illustrated in FIG. 7*d* upon the back of said precut frame with insert having been mounted therein as illustrated in FIG. 7*c*.
Figure 7F:
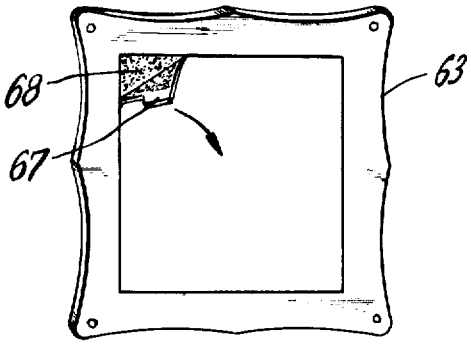
FIG. 7*f* depicts the sixth step in the process of mounting a decorative insert onto the exterior cover of said album in accordance with a second alternative embodiment of the invention wherein there is removed the remaining protective covering from said second adhesive sheet as illustrated in FIG. 7*d*.
Figure 7G:
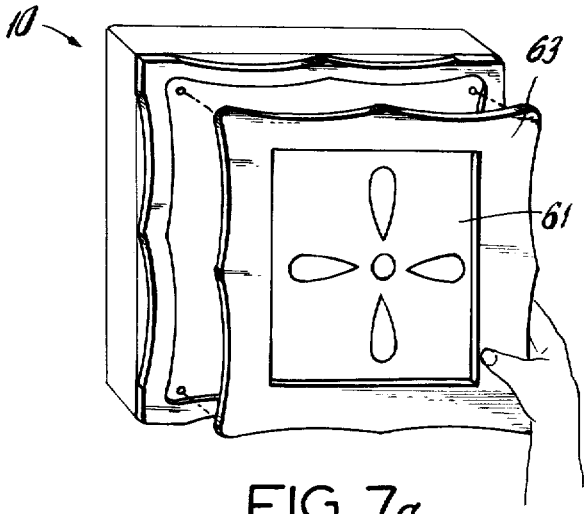
FIG. 7*g* depicts the seventh step in the process of mounting a decorative insert onto the exterior cover of said album in accordance with a second alternative embodiment of the invention wherein there is illustrated the step of placing said decorative insert upon the exterior cover of said album at the appropriate location thereon.

It should be noted, and as illustrated in FIG. 8, album 10 is a prebound album consisting of uniquely designed pages such that the album gives the appearance that each page thereof has mounted thereon a picture and thereafter, once all of the pages have mounted thereon their respective pictures, then the entire album is bound.

The above is achieved in part by the fact that each page of said album is constructed in accordance with the design depicted in FIG. 8 wherein there is illustrated a page 17 of said album 10 constructed in accordance with this invention wherein page 17 comprises a base member 18 with border members 19 and 20, said border members 19 and 20 being adhesively affixed to base member 18 such that page 17 evidences a flat plane surface with symmetrical recesses appearing upon both plane surfaces of page 17, said recesses being capable of having mounted therein a picture or the like in accordance with the invention so as to give the appearance that each page had mounted thereon a picture and thereafter, once all of the pages of said album had been mounted with their respective pictures, said pages were then assembled and the entire album then bound.

In accordance with the invention, page 17 has, along the edge thereof that becomes bound with other pages similar thereto so as to constitute album 10, a fold 21 traversing the full height of base member 18 so as to allow flap member 22 of base member 18 to be folded back onto base member 18 along fold 21. To accomplish the binding of a page 17 of album 10 to another page 17 of said album so as to in fact create an album, there is first assembled as many pages 17 as are desired for a particular album, then adhesive means well known in the prior art is placed upon that surface of flap member 22 that does not come into contact with base member 18 when flap member 22 is folded along fold 21 back upon the surface of base member 18, same being done to all of the flap members 22 associated with as many of pages 17 as will constitute a particular album. In such fashion, pages 17 are assembled and bound to each other in accordance with the invention, there additionally being utilized additional binding techniques well known in the prior art so as to accomplish the secure affixing of pages 17 to each other and to the remaining structure of album 10.

In further keeping with the invention, base member 18 additionally has formed therein fold 23 appearing on both faces of base member 18 and traversing the full height of base member 18, so as to provide a means to facilitate the opening to and the turning of the pages 17 of album 10, fold 23 being parallel to fold 21 and positioned a perpendicular distance away from fold 21 equal to or slightly in excess of the width of flap member 22. Furthermore, the thicknesses of borders members 19 and 20 as well as base member 18 and thus flap member 22 are all identical thereby resulting in, upon opening of said bound album, to any page thereof, the accomplishing of a uniform plane surface across both pages of said opened album inclusive of the point of binding.

Reference is now herein made to FIGS. *3a–3g* wherein there is depicted an alternative embodiment to the method of fabricating an album in accordance with this invention. More particularly, in FIG. *3a* there is depicted a rear elevational view of mat assembly 24, mat assembly 24 comprising a mat 25 which is constructed from any material well known in the prior art for same, and preferably constructed of a thick composition of paper material evidencing properties of strength and decorative aesthetic appearance, there being symmetrically positioned upon mat 25 an adhesive surface 26 consisting of any well known adhesive material available within the prior art, said adhesive material 26 being covered by protective sheet 27 so as to prevent items adhering to said adhesive material 26 prior to the mounting of a picture upon mat 25. Additionally bordering the area covered by adhesive material 26 is a pre-cut indentation 28 that becomes exposed by removing covering member 29, said pre-cut indentation being into the surface of mat 25 but of a depth less than the thickness of mat 25.

In keeping with this alternative embodiment of the invention, the first step in mounting a picture or other decorative item in accordance with the invention is to remove protective sheet 27 so as to expose adhesive material 26 as depicted in FIG. *3a*. Next, covering member 29 is removed so as to expose indentation 28 as depicted in FIG. *3b*. The next step in mounting a picture or other decorative item in accordance with the invention is to insert within the confines defined by indentation 28 a picture 30 or other decorative item such that the back of picture 30 comes into direct contact with adhesive material 26 thereby binding picture 30 to mat 25. It should be noed that as depicted, the dimensions of picture 30 and those of indentation 28 are identical so that there is achieved a uniform aesthetic appearance to mat 25 once picture 30 is place thereon as defined above.

Once picture 30 is mounted within the confines of indentation 28 of mat 25 as depicted in FIG. *3c*, there is then removed protective covering 31 that is affixed to the back surface of mat assembly 24 so as to expose adhesive surface 32 which comprises any well known adhesive material available within the prior art, said step being depicted in FIG. *3d*. Thereafter, and as the next step in the process of this alternative embodiment of the invention, mat assembly 24 is positioned so that its exposed adhesive surface 32 comes into direct contact with a page 17 of said album so as to become permanently affixed to page 17, said step being depicted in FIG. *3e*. It should further be noted that the overall dimensions of mat assembly 24 and the symmetrical recess opening of page 17 are equal so as to achieve a uniform aesthetic appearance to the mounting of mat assembly 24 upon page 17.

Upon mounting mat assembly 24 upon page 17 as depicted in FIG. *3e*, there is then removed protective covering 33 as depicted in FIG. *3f* thereby exposing an adhesive surface 34 which borders picture 30 so that as the final step in fabricating an album in accordance with this alternative embodiment of the invention there is then placed over picture 30 and in direct contact with adhesive surface 34, as depicted in FIG. *3g*, frame member 35 which has a pre-cut opening symmetrically positioned therein so as to expose to desired dimensions picture 30 as it appears on page 17 of album 10. It should be noted that the dimensions of frame member 35 are identical to those of the symmetrical recess of page 17 such that upon the mounting of frame member 35 upon adhesive surface 34 there is achieved a uniform aesthetic appearance to the mounting of picture 30 upon page 17 so as to achieve a uniform plane surface across the face of page 17, same being achieved in accordance with the invention by having the depth of the symmetrical recess of page 17 equal to the combined thicknesses of mat assembly 24 as mounted upon page 17 and frame member 35.

Reference is now herein made to FIGS. *4a–4d* wherein there is depicted a second alternative embodiment to the method of fabricating an album in accordance with this invention wherein there is depicted in FIG. *4a* a mat assembly 36, mat assembly 36 comprising a mat 37 which is constructed from any material well known in the prior art for same, and preferably constructed of a thick composition of paper material evidencing properties of strength and decorative aesthetic appearance, there being symmetrically positioned within mat 37 an opening that is bordered by an adhesive surface 38 which has protective covering 69 appearing thereon to prevent exposing adhesive surface 38 prior to its utilization in accordance with the invention, adhesive surface 38 being any well known adhesive material available within the prior art.

In keeping with this second alternative embodiment to the method of fabricating an album in accordance with this invention, and as depicted in FIG. *4a*, there is initially removed protective covering 69 thereby exposing an indented recessed area 39 whose dimensions are equal to those of picture 40 or other decorative item that is to be mounted on page 17 of album 10 in accordance with this second alternative embodiment of the invention, there also being exposed by the removal of protective covering 69 adhesive surface 38.

As depicted in FIG. *4b*, the next step in mounting a picture onto page 17 of album 10 in accordance with this second alternative embodiment of this invention is to place picture 40 within recessed area 39 of mat 37, with the front of said picture being in direct contact with adhesive surface 38 thereby mounting picture 40 onto mat 37.

The next step as depicted in FIG. *4c* in mounting a picture onto page 17 of album 10 in accordance with this second alternative embodiment of the invention is to remove protective covering 41 from the back of mat 37 thereby exposing adhesive surface 42 which borders the indented recessed area 39 of mat 37. In keeping with the invention, mat assembly 36 is then mounted upon page 17 of album 10 as depicted in FIG. *4d* by placing mat assembly 36 within the symmetrical recess of page 17 so that adhesive surface 42 appearing on mat assembly 36 comes into direct contact with page 17, mat assembly 36 having dimensions identical to those of the symmetrical recess of page 17 and the depth of the symmetrical recess of page 17 is equal to the thickness of mat assembly 36 so as to achieve a uniform aesthetic appearance to the mounting of mat assembly 36 upon page 17.

In accordance with the invention, and as illustrated in FIGS. *5a–5d*, there is depicted a method of fabricating a photographic album wherein there is illustrated a method whereby a decorative insert panel can be selectively mounted upon the exterior front cover of said album.

Figure 5A:
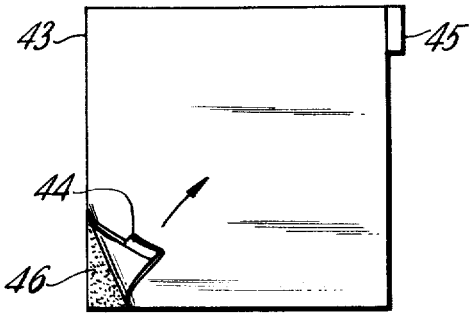
FIG. 5*a* is a front elevational view of an adhesive sheet constructed in accordance with this invention, said adhesive material appearing on both of the surfaces of said adhesive sheet, same being utilized in accordance with the invention for mounting a decorative insert onto the exterior cover of said album wherein there is initially exposed one surface of said adhesive sheet as the first step in the process of mounting a decorative insert onto the exterior cover of said album in accordance with the invention.
Figure 5B:
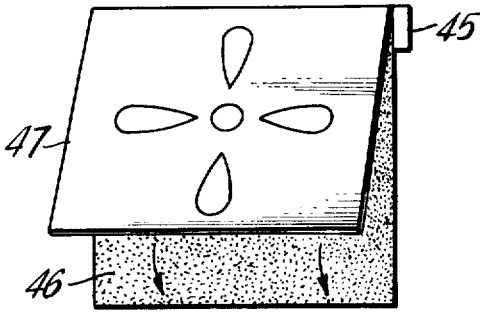
FIG. 5*b* evidences the second step in the process of mounting a decorative insert onto the exterior cover of said album in accordance with the invention wherein there is depicted the placing of the back of said decorative insert onto the exposed adhesive surface of said adhesive sheet after said adhesive surface is exposed as a result of the first step in this process.
Figure 5C:
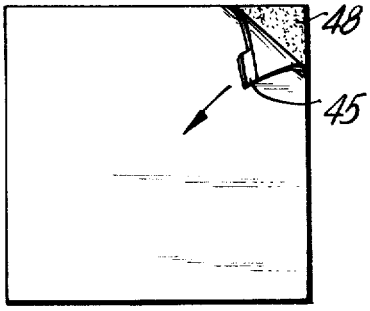
FIG. 5*c* represents the third step in the process of mounting a decorative insert onto the exterior cover of said album in accordance with the invention wherein said adhesive sheet has its second adhesive surface exposed.
Figure 5D:
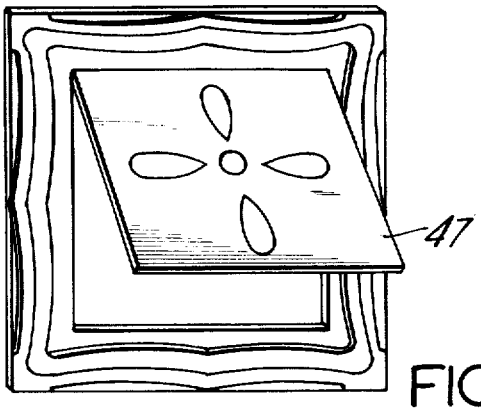
FIG. 5*d* represents the fourth step in the process of mounting a decorative insert onto the exterior cover of said album in accordance with the invention wherein said decorative insert is mounted upon the exterior cover of said album.
Figure 6A:
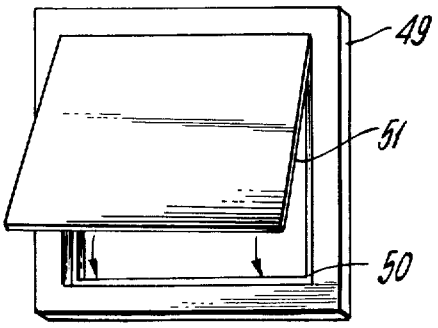
FIG. 6*a* is a rear elevational view of the first step in accordance with a first alternative embodiment of the invention wherein a decorative insert is to be mounted upon the exterior cover of an album wherein said decorative insert is mounted within a prefabricated frame.
Figure 6B:
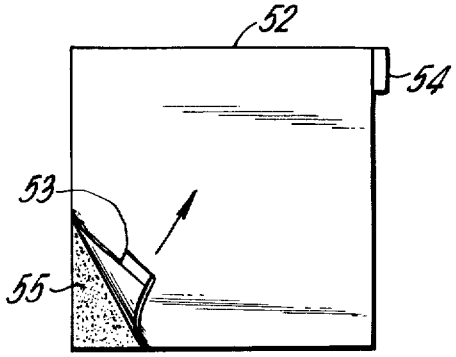
FIG. 6*b* is a front elevational view of an alternative embodiment of the invention applicable to the mounting of a decorative insert upon the exterior cover of an album wherein an adhesive sheet constructed in accordance with the invention is depicting the second step associated with said mounting wherein there is evidenced the exposing of an adhesive surface of said adhesive sheet.
Figure 6C:
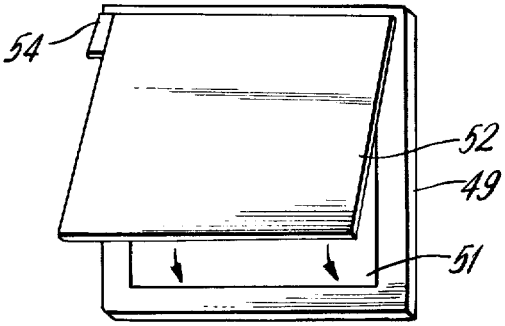
FIG. 6*c* depicts the third step in accordance with an alternative embodiment of the invention applicable to mounting a decorative insert onto the exterior surface of an album wherein the exposed adhesive surface evidenced in FIG. 6*b* is mounted upon the frame as depicted in FIG. 6*a* after the decorative insert has been placed within said frame.
Figure 6D:
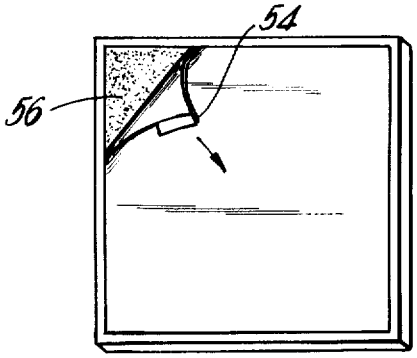
FIG. 6*d* depicts the fourth step in accordance with an alternative embodiment of the invention applicable to mounting a decorative insert onto the exterior cover of said album wherein there is exposed the second adhesive surface of said adhesive sheet depicted in FIG. 6*b*.
Figure 6E:
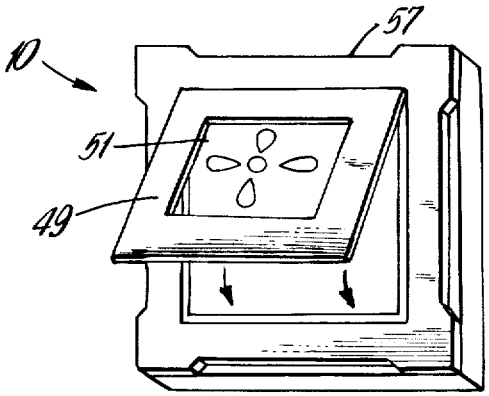
FIG. 6*e* depicts the fifth step in accordance with an alternative embodiment of the invention applicable to mounting a decorative insert onto the exterior cover of said album wherein said decorative insert is mounted upon the exterior cover of said album.

As depicted in FIG. *5a*, adhesive sheet 43 which has adhesive material appearing on both of its surfaces and which has protective coverings 44 and 45 respectively covering said adhesive surfaces, initially has removed protective covering 44 removed from adhesive sheet 43 thereby exposing adhesive surface 46. A decorative panel 47 then has its rear surface symmetrically placed upon exposed adhesive surface 46 as depicted in FIG. *5b. As depicted in FIG. 5c,* protective covering 45 is then removed exposing adhesive surface 48 whereupon as depicted in FIG. *5d*, decorative panel 47 is placed within a predefined recess appearing on the front cover of album 10 and becomes permanently affixed thereto, the dimensions of said recess, decorative panel 47 and adhesive sheet 43 all being identical such that there is achieved in accordance with the invention the ability to provide a means whereby the purchaser of an album can selectively determine the aesthetic appearance of the front cover of an album which will give the appearance that same was tailor made for said individual.

In FIGS. *6a–6e* there is depicted an alternative embodiment to the method of mounting a decorative insert panel upon the exterior front cover of said album in accordance with the invention wherein in FIG. *6a* there is depicted a decorative frame member 49 constructed from any desired material and of any desired decorative design, said decorative frame member 49 having a symmetrically positioned opening therein with recessed grove 50 bordering said opening and capable of receiving decorative insert panel 51, the dimensions of decorative insert panel 51 and those of recessed grove 50 being identical such that decorative insert panel 51 can be placed within recessed grove 50 of decorative frame member 49, the depth of recessed grove 50 and the thickness of decorative insert panel 51 being identical such that once mounted within recessed grove 50, the back surface of decorative insert panel 51 and the back surface of decorative frame member 49 define a single plane surface.

In keeping with the invention, the first step in mounting a decorative insert panel 51 in accordance with an alternative embodiment of the invention as depicted in FIG. *6a* is to insert said decorative panel 51 into recessed grove 50, the decorative face of decorative panel 51 facing out through the symmetrical opening appearing therein.

Once decorative panel 51 has been placed within recessed grove 50 of decorative frame member 49, there is removed from adhesive sheet 52, which has both of its surfaces covered with any adhesive material well known in the prior art that is suited to adhering to various compositions of paper and which has protective coverings 53 and 54 covering said adhesive surfaces, protective covering 53 so as to expose adhesive surface 55 as depicted in FIG. *6b*. The next step is to place adhesive sheet 52 with its exposed adhesive surface 55 symmetrically upon the back of the assembled decorative insert panel 51 and decorative frame member 49 thereby permanently affixing decorative insert panel 51 to decorative frame member 49, said adhesive sheet 52 having dimensions compatible with those of decorative frame member 49 so as to accomplish the above. See FIG. *6c*.

As depicted in FIG. *6d*, once adhesive sheet 52 has been affixed to the back of the assembled decorative insert panel 51 and decorative frame member 49 as depicted in FIG. *6c*, there is then removed protective covering 54 exposing adhesive surface 56, the entire combination of decorative insert panel 51, decorative frame member 49 and adhesive sheet 52 with its exposed adhesive surface 56 then being placed onto the front cover 57 of album 10 within the prefabricated recess appearing therein as depicted in FIG. *6e*.

In FIG. *7a–7g* there is depicted a second alternative embodiment to the method of mounting a decorative insert panel upon the exterior front cover of said album in accordance with the invention wherein the decorative insert panel is envisioned to be a pictorial representation of a composition such that same does not evidence a great deal of structural integrity. As evidenced in FIG. *7a*, there is depicted adhesive sheet 58 wherein only one surface thereof is covered with an adhesive material well known in the prior art which is suited to adhering to various compositions of paper, and the like, and which has protective covering 59 covering said adhesive surface, the first step being, in accordance with this second alternative embodiment, as to mounting a decorative insert panel upon the front exterior cover of album 10, is, to remove protective covering 59, so as to expose adhesive surface 60.

As depicted in FIG. *7b*, decorative insert panel 61 is then placed in contact with adhesive surface 60 of adhesive sheet 58, such that adhesive sheet 58 becomes affixed to the back surface of decorative insert panel 61.

The next step in said process, as depicted in FIG. *7c* is to position decorative insert panel 61 within recess grove 62 of decorative frame member 63, decorative frame member 63 having symmetrically positioned therein a recessed opening with recessed grove 62 being symmetrically positioned around said recessed opening. After decorative insert panel 61 has been placed face down into recessed opening 62 of decorative frame member 63, as depicted in FIG. *7c*, the next step is to remove protective covering 64 from adhesive sheet 65 so as to expose adhesive surface 66 as depicted in FIG. *7d*, adhesive sheet 65 then being placed symmetrically upon the back surfaces of decorative insert panel 61 and frame member 63 as depicted in FIG. *7e*, so as to permanently affix decorative insert panel 61 to frame member 63, the dimensions of adhesive sheet 65 being of a size such that adhesive sheet 65 is larger than the overall dimensions of decorative insert panel 61, but less than the overall dimensions of frame member 63.

As the next step in accordance with this alternative embodiment of the invention for mounting a decorative insert panel upon the front cover of an album, in accordance with the invention, there is then removed protective sheet 67 from adhesive sheet 65 as depicted in FIG. *7f* thereby exposing adhesive surface 68 so that upon mounting the entire combination of decorative insert panel 61, decorative frame member 63 and adhesive sheet 65 onto the front cover of album 10 as depicted in FIG. *7g*, within the recess provided therein, there is permanently affixed to the front cover of album 10 said decorative insert panel 61 with its surrounding frame member 63.

The preceeding description and accompanying drawings relate primarily to a specific embodiment of the invention, and the invention in its broader aspect should not be so limited to one specific embodiment as herein shown and described, but departures may be made therefrom within the scope of the accompanying claims without departing from the principals of the invention and without sacrificing its chief advantages.

I claim:

1. A process of fabricating an album having a prebound binding wherein upon the individual pages thereof items of an aesthetic nature are capable of being mounted so as to create an album whose pages once having pictures mounted thereon provide a uniform plane surface, said process comprising the steps of;

(a) removing a first protective covering from the back surface of a mat assembly, said mat assembly comprising;

(i) a mat having a front surface and a back adhesive surface that defines a symmetrically positioned opening therein, therebeing an indented adhesive surface bordering said opening formed within the back face of said mat, said indented adhesive surface defining a recessed area formed only within the back surface of said mat;

(ii) a first protective covering being removeably affixed to said indented adhesive surface, said indent and said adhesive surface only becoming exposed upon the removal of said first protective covering; and (iii) a second protective covering removeably affixed to the remaining portion of said back adhesive surface of said mat not covered by said first protective covering;

(b) placing an item of aesthetic nature within said indented adhesive recessed area formed within the back surface of said mat such that the face of said item of aesthetic nature comes into direct contact with said indented adhesive surface, said item of aesthetic nature having dimensions identical to said recessed area formed within the back surface of said mat, such that said item of aesthetic nature fits exactly within the confines of said indented recess, the depth of said indented recess and the thickness of said item of aesthetic nature being identical;

(c) removing said second protective covering from the back adhesive of said mat assembly so as to uncover an adhesive surface that borders the back surface of said mat assembly; and (d) mounting said mat assembly onto a page of said album, such that said back adhesive surface exposed by the removal of said second protective covering comes into contact with said page, each of said pages of said album comprising;

(i) a base member having a first surface and a second surface, a fold being formed within both surfaces of said base member, symmetrical with respect to each other, said folds traversing both surfaces of said base member parallel to the binding of said page within said album;

(ii) a first border member and a second border member, identical in shape to each other, said first and second border members each defining a symmetrically positioned opening therein identical in size to said mat assembly, said first border member being affixed to one surface of said base member and said second border member being affixed to said second surface of said base member such that there is defined a recessed area as to each surface of said page, said recessed area of each surface of said page being identical in depth to the thickness of said mat assembly such that when said mat assembly is mounted on said page, the entire surface of said page with mounted mat assembly presents a uniform planar surface.

2. A process of fabricating an album having a prebound binding wherein upon the individual pages thereof items of an aesthetic nature are capable of being mounted so as to create an album whose pages once having pictures mounted thereon provide a uniform plane surface as described in claim 1 wherein said mat assembly defines a non-symmetrically positioned opening therein.

3. A process of fabricating an album having a prebound binding wherein upon the individual pages thereof items of an aesthetic nature are capable of being mounted so as to create an album whose pages once having pictures mounted thereon provide a uniform plane surface as described in claim 1 wherein said mat assembly defines a plurality of defined openings therein.

4. A process of fabricating an album having a prebound binding wherein upon the individual pages thereof items of an aesthetic nature are capable of being mounted so as to create an album whose pages once having pictures mounted thereon provide a uniform plane surface as described in claim 3 wherein the plurality of defined openings formed within said mat assembly appear symmetrically therein.

5. A process of fabricating an album having a prebound binding wherein upon the individual pages thereof items of an aesthetic nature are capable of being mounted so as to create an album whose pages once having pictures mounted thereon provide a uniform plane surface as described in claim 1, wherein each of said base members of said pages of said album have a flap member, each flap member being structurally bound to the base member of an adjacent album page so as to form said prebound binding of said album.

6. A process of fabricating an album having a prebound binding wherein upon the individual pages thereof items of an aesthetic nature are capable of being mounted so as to create an album whose pages once having pictures mounted thereon provide a uniform plane surface, said process comprising the steps of;

(a) removing a first protective covering from the back surface of a mat assembly, said mat assembly comprising;

(i) a mat having a front surface and a back surface, said mat defining an opening positioned therein, an adhesive material affixed to the entire back surface of said mat, (ii) a first protective covering being removeably affixed to said back surface of said mat appearing immediately adjacent to said opening, an indent and that portion of said adhesive surface appearing immediately adjacent to said opening being exposed upon the removal of said first protective covering, and (iii) a second protective covering removeably affixed to the remaining portion of said back surface of said mat not covered by said first protective covering;

(b) placing an item of aesthetic nature within said indented adhesive recessed area formed upon removing of said first protective covering such that the face of said item of aesthetic nature comes into direct contact with said exposed adhesive surface, said item of aesthetic nature having dimensions identical to said exposed adhesive surface, such that said item of aesthetic nature fits exactly within the confines of said indent and portion of said adhesive surface exposed upon removing of said first protective covering, the depth of said indent and the thickness of said item of aesthetic nature being identical;

(c) removing said second protective covering from the back surface of said mat assembly so as to uncover an adhesive surface that borders the back surface of said mat assembly; and (d) mounting said mat assembly onto a page of said album, such that said back adhesive surface exposed by the removal of said second protective covering comes into contact with said page, each of said pages of said album comprising;

(i) a base member having a first surface and a second surface, a fold being formed within both surfaces of said base member, symmetrical with respect to each other, said folds traversing both surfaces of said base member parallel to the binding of said page within said album;

(ii) a first border member and a second border member, identical in shape to each other, said first and second border members each defining a symmetrically positioned opening therein identical in size to said mat assembly, said first border member being affixed to one surface of said base member and said second border member being affixed to said second surface of said base member such that there is defined a recessed area as to each surface of said page, said recessed area of each surface of said page being identical in depth to the thickness of said mat assembly such that when said mat assembly is mounted on said page, the entire surface of said page with mounted mat assembly presents a uniform planar surface.

* * * * *